US005638568A

United States Patent [19]

Dumler et al.

[11] Patent Number: 5,638,568

[45] Date of Patent: Jun. 17, 1997

[54] SMALL BRUSH, IN PARTICULAR INTERDENTAL BRUSH

[75] Inventors: Norbert Dumler; Bernd Fellner, both of Ansbach, Germany

[73] Assignee: georg karl geka-brush GmbH, Bechhofen-Waizendorf, Germany

[21] Appl. No.: 591,678

[22] PCT Filed: Aug. 13, 1994

[86] PCT No.: PCT/EP94/02714

§ 371 Date: Feb. 16, 1996

§ 102(e) Date: Feb. 18, 1996

[87] PCT Pub. No.: WO95/05762

PCT Pub. Date: Mar. 2, 1995

[30] Foreign Application Priority Data

Aug. 21, 1993 [DE] Germany ..... 9312577 U

[51] Int. Cl.[6] ..... A46B 9/04; A46B 3/18

[52] U.S. Cl. ..... 15/167.1; 15/206

[58] Field of Search ..... 15/206, 207, 159.1, 15/160, 167.1; 132/321; 300/21

[56] References Cited

U.S. PATENT DOCUMENTS

| | | | |
|---|---|---|---|
| 2,580,378 | 12/1951 | Peterson et al. | 15/206 |
| 2,972,157 | 2/1961 | Peterson | 15/206 |
| 3,124,823 | 3/1964 | Charvat | 15/206 |
| 3,878,580 | 4/1975 | Stohr et al. | 15/206 |
| 4,395,943 | 8/1983 | Brandli | 15/206 |
| 5,161,554 | 11/1992 | Fitjer | 15/207.2 |
| 5,161,555 | 11/1992 | Cansler et al. | 132/216 |

FOREIGN PATENT DOCUMENTS

| | | |
|---|---|---|
| 2085718 | 5/1982 | United Kingdom . |

OTHER PUBLICATIONS

Patent Abstract of Japanese Application 05/305,007 published 19 Nov. 1993.

*Primary Examiner*—Tony G. Soohoo
*Attorney, Agent, or Firm*—Browdy and Neimark

[57] ABSTRACT

In a small brush, in particular an interdental brush, comprising a plurality of fibers or bristles (5) which are secured so as to protrude radially between two wire-type segments (1, 2) by twisting the latter, it is provided, with a view to improve the properties of handling and dental care, that the wire-type segments (1, 2) comprise at least one plastic fiber (3).

5 Claims, 1 Drawing Sheet

SMALL BRUSH, IN PARTICULAR INTERDENTAL BRUSH

FIELD OF INVENTION

The invention relates to a small brush, in particular an interdental brush, comprising a plurality of fibers or bristles, respectively, which are secured so as to protrude radially between two wire-type segments by twisting the latter.

BACKGROUND

In small brushes of the generic type, the wire-type segments consist of metal wire, i.e. metal wire coated with plastic or of plasticized metal wire.

These small brushes of the generic type have the disadvantage that there is a risk of rupture of the wire when exposed to alternate bending stresses, i.e. repeated alternate bending. As a rule, there is a risk of rupture already at approximately 20 alternate bending stresses on an average, even wires of 0.20 to 0.50 mm of diameter, although most carefully selected, not taking more than 50 to 60 stresses of this kind.

If the wire of the twisted wire segments breaks off, the user can hurt his mouth and throat during use and there is a risk of swallowing the pieces broken off.

The fiber or bristle segments protruding radially are held by the torque of the twisted wire and may disengage. These disengaged fiber segments can either get stuck or jammed in interdental spaces or gaps, which causes a very unpleasant sensation.

Finally, the wire segments conventionally used can cause galvanic effects when these wires come into contact with fillings. Even a plastic coating cannot prevent such effects completely, as the plastic coating can become cracked during manufacturing or in subsequent treatment, the cracks not being important mechanically, but sufficient to enable a certain electric conductivity in connection with saliva and to make unpleasant galvanic reactions sensible.

SUMMARY OF INVENTION

Proceeding from this, it is the object of the invention to further develop a small brush of the type under regard such that the properties of handling and dental care are improved further.

According to the invention, this object is solved by the wire-type segments comprising at least one plastic fiber. Surprisingly, the plastic fibers, when appropriately selected, have proven—with regard to their twisting characteristics—to exhibit properties very similar to those known from conventionally used wires, i.e. the twisted plastic fiber segments remain in a twisted condition without untwisting automatically, so that they have the ability to hold the fibers or bristles, respectively, or bundles of fibers or bristles, respectively, disposed between them in such a way that they protrude radially.

BRIEF DESCRIPTION OF DRAWING

Details of the invention will become apparent from the ensuing description of a preferred embodiment, taken in conjunction with the drawing, in which.

DETAILED DESCRIPTION OF EMBODIMENTS

Figure 1:
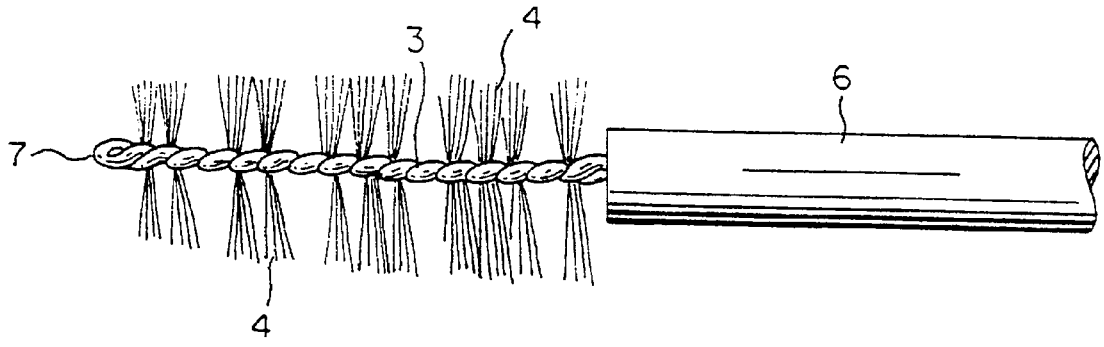
FIG. 1 is a diagrammatic lateral view of a small brush according to the invention.
Figure 2:
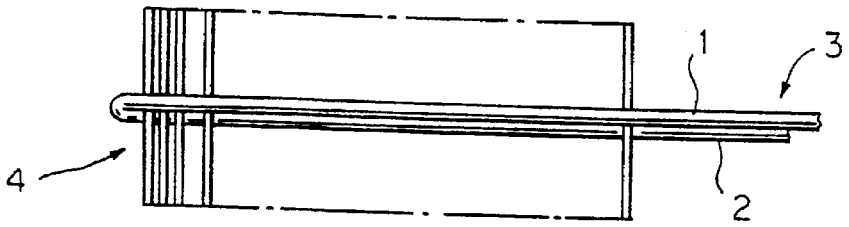
FIG. 2 is a lateral view prior to the twisting of the fiber segments.

The drawing shows two segments 1, 2 of a plastic fiber 3 bent in the shape of a U. Bristles 4 are inserted between the segments 1, 2, as can be seen from FIG. 2. The segments 1, 2 are then twisted in a manner known per se so that the bristles 4 protrude radially in all directions. A loop 7 is thus formed at the tip end. The bristles 4 form an outer envelope curve, which can also be formed or corrected by subsequent trimming. In the illustrated embodiment, the ends of the segments 1, 2 are secured in a sleeve handle 6; however, as is known from interdental brushes, they can also be bent off and secured replaceably in a special holder.

Plastic materials suitable for the fiber segments under regard which are to be twisted are preferably polyamide, polyacryl, polypropylene, polyester, polycarbonate, PBT, PEEC, which are reinforced by the aid of glass fibers or spherolites or the like.

In a further embodiment of the invention it can be provided that the cross-section of the plastic fiber ranges between 0.025 and 1.5 mm.

Moreover, fillers such as glass fibers or talcum can be added to the fibers.

These fillers can also include abrasives, such as silicon carbide or the like. Fibers of that kind are per se known from brushes, the more resistant aluminum oxide being suitable besides silicon carbide. Products are commercially available under the tradename "Tynex" containing silicon carbide of grain sizes between 46 and 500 and aluminum oxide of grain sizes between 80 and 500 at a grain content of 30 percent.

When used in dentistry, small brushes of this design have the advantage of ensuring, both in a brand-new and in a used condition, that there will be no galvanic effect whatsoever owing to the core of the brush being produced from solid plastic material, that the bristles protruding radially are retained reliably, and that the fillers help procure an additional effect, for instance an abrasive effect, for the twisted fibers.

In keeping with another advantageous embodiment of the invention, also the restoring capacity and the rigidity of the plastic material can be adjusted with the aid of fillers so that in this way the twisted fibers can be designed to behave similar to conventionally used metal wire. Also, the selection of the cross-section and the cross-sectional geometry can control the behavior of the fibers.

The radially protruding fibers can be selected so as to fan out under mechanical or chemical influences so that bundles of relatively fine fibers or bristles can be produced after the twisting.

Furthermore, it can be provided that the radially protruding fibers or bristles are wavy, for example in order to thus achieve a random distribution of the bristle tips along the circumference.

What is claimed is:

1. A small brush adapted for use as an interdental brush, comprising a plastic fiber (3) having a cross-section between 0.025 and 1.5 mm bent in the shape of a U to form two elongated legs (1, 2) thereof, said two elongated legs being twisted about one another, a plurality of fine bristles (4) extending radially from between and held by said twisted elongated legs (1, 2) of said U-shaped plastic fiber (3), and a loop (7) at a forward end of said twisted elongated legs (1, 2).

2. A small brush according to claim 1, wherein said U-shaped plastic fiber (3) contains a reinforcing material.

3. A small brush according to claim 1, wherein said U-shaped plastic fiber (3) contains a filler.

4. A small brush according to claim 1, in the form of an interdental brush, wherein said U-shaped plastic fiber (3) contains an abrasive selected from the group consisting of aluminum oxide and silicon carbide.

5. An interdental brush according to claim 4 wherein said abrasive is present in an amount of up to about 30% by weight.

* * * * *